US006508661B1

(12) United States Patent
Yu

(10) Patent No.: US 6,508,661 B1
(45) Date of Patent: Jan. 21, 2003

(54) FLEXIBLE PRINTED CIRCUIT CONNECTOR

(75) Inventor: Hung-Chi Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/023,628

(22) Filed: Dec. 17, 2001

(51) Int. Cl.[7] ..... H01R 12/24
(52) U.S. Cl. ..... 439/495; 439/498; 439/631
(58) Field of Search ..... 439/260, 495, 439/498, 631

(56) References Cited

U.S. PATENT DOCUMENTS 3,307,139 A * 2/1967 Prise ..... 439/495
3,325,769 A * 6/1967 Travis ..... 439/496
3,941,448 A * 3/1976 Evans ..... 439/493
5,277,621 A * 1/1994 Seto ..... 439/493
5,501,610 A * 3/1996 Ikemoto ..... 439/260
6,146,172 A * 11/2000 Wu et al. ..... 439/260
6,250,966 B1 * 6/2001 Hashimoto et al. ..... 439/495
6,364,695 B1 * 4/2002 Watanabe ..... 439/410

* cited by examiner

*Primary Examiner*—Tulsidas Patel
(74) *Attorney, Agent, or Firm*—Wei Te Chung

(57) ABSTRACT

An FPC connector (1, 1') includes a housing (10, 10') defining a chamber (11, 11') and a plurality of cavities (12, 12'). A plurality of terminals (20, 20') is received in the housing, each having a first resilient arm (22, 22') received in the chamber and a second resilient arm (24, 24') received in the cavity. A stuffer bar (30) is received in the chamber of the housing for carrying a first flexible printed circuit (FPC) (51) to connect with the first resilient arms of the terminals. A plurality of stuffer blocks (40) is received in the cavities for carrying a plurality of second FPCs (52) to electrically connect with the second resilient arms of the terminals.

9 Claims, 5 Drawing Sheets

FLEXIBLE PRINTED CIRCUIT CONNECTOR

BACKGROUND OF THE INVENTION

1. Field of the Invention

The present invention relates to flexible printed circuit (FPC) connectors, and particularly to an FPC connector for connecting a plurality of FPCs.

2. Prior Art

Various connectors are widely used in electronic devices for readily electrically connecting different devices or components. FPC connectors, as one type of connectors, are often adopted to electrically connect different subsystems thereby achieving signal transmissions.

FIG. 1 shows a conventional FPC connector 2 to be mounted on a printed circuit board (PCB). The FPC connector 2 defines a receptacle 3 for receiving and electrically connecting an end of an FPC 4.

However, the receptacle 3 can connect only one FPC. This means that a connector is required to mount on a PCB when a subsystem is required to connect the PCB. When more subsystems are connected with the PCB, more connectors are mounted on the PCB. Since each connector occupies certain space in the PCB, more connectors occupy more space in the PCB, which does not meet miniaturization requirement of PCBs.

SUMMARY OF THE INVENTION

Accordingly, an object of the present invention is to provide an FPC connector for connecting multiple FPCs thereby occupying minimized space in a PCB.

To achieve the above-mentioned object, an FPC connector in accordance with the present invention includes a housing defining a chamber and a plurality of cavities. A plurality of terminals is received in the housing, each having a first resilient arm received in the chamber and a second resilient arm received in the cavity. A stuffer bar is received in the chamber of the housing for carrying a first flexible printed circuit (FPC) to connect with the first resilient arms of the terminals. A plurality of stuffer blocks is received in the cavities for carrying a plurality of second FPCs to electrically connect with the second resilient arms of the terminals.

Other objects, advantages and novel features of the present invention will be drawn from the following detailed description of preferred embodiments of the present invention with attached drawings, in which:

DETAILED DESCRIPTION OF THE PREFERRED EMBODIMENTS

Figure 1:
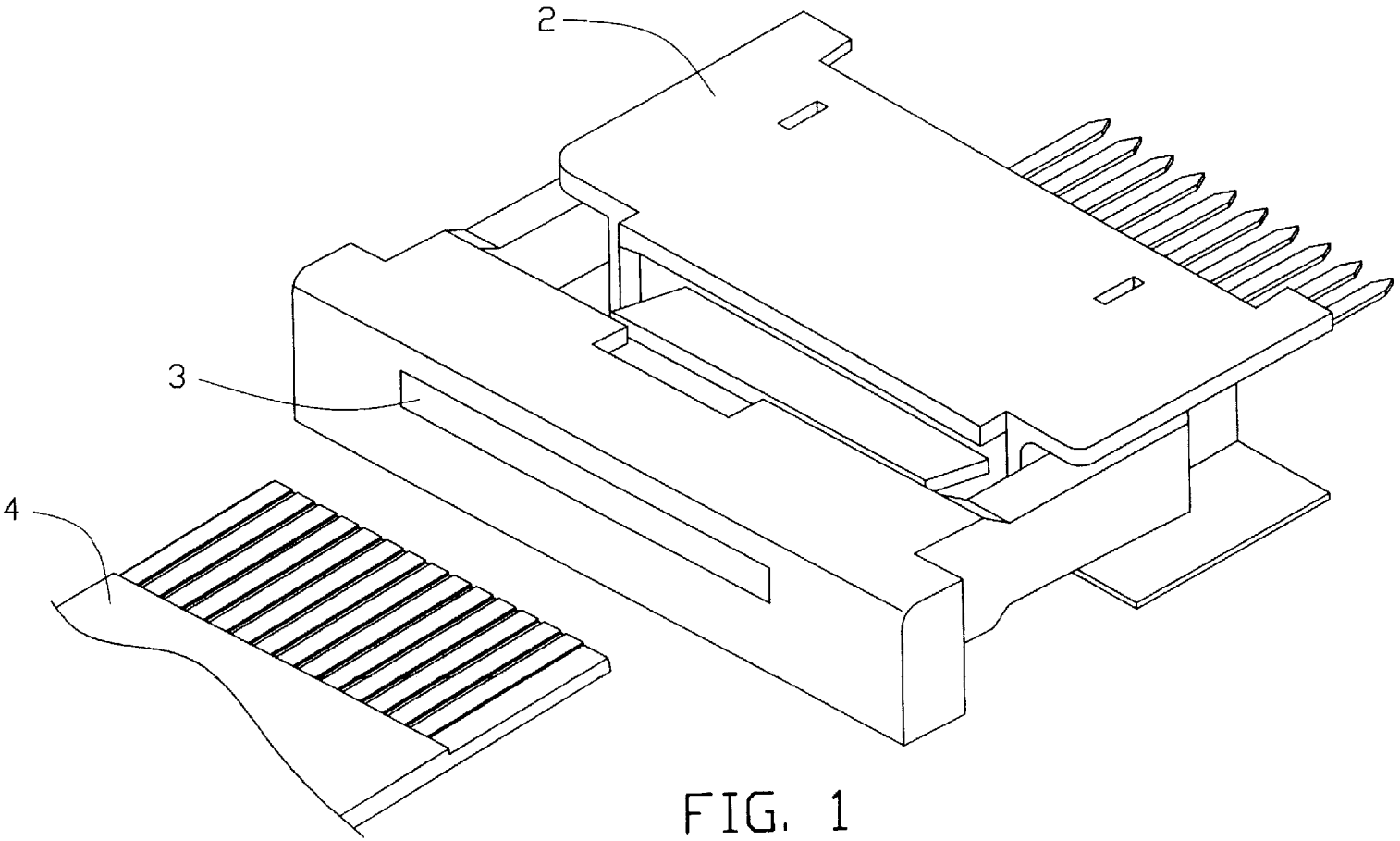
FIG. 1 (PRIOR ART)
FIG. 1 is a perspective view of a conventional FPC connector.
Figure 2:
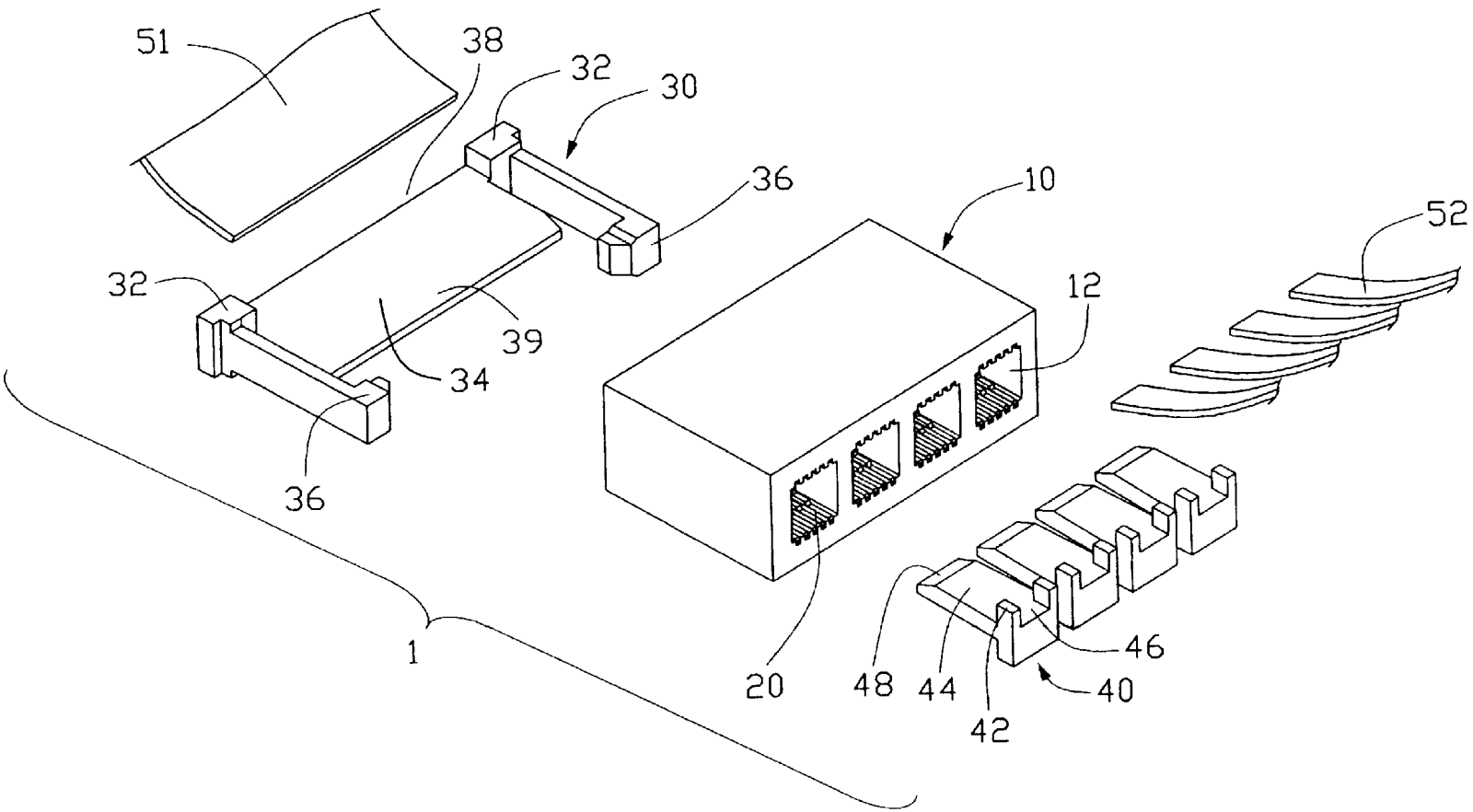
FIG. 2 is an exploded view of an FPC connector of a preferred embodiment in accordance with the present invention.
Figure 3:
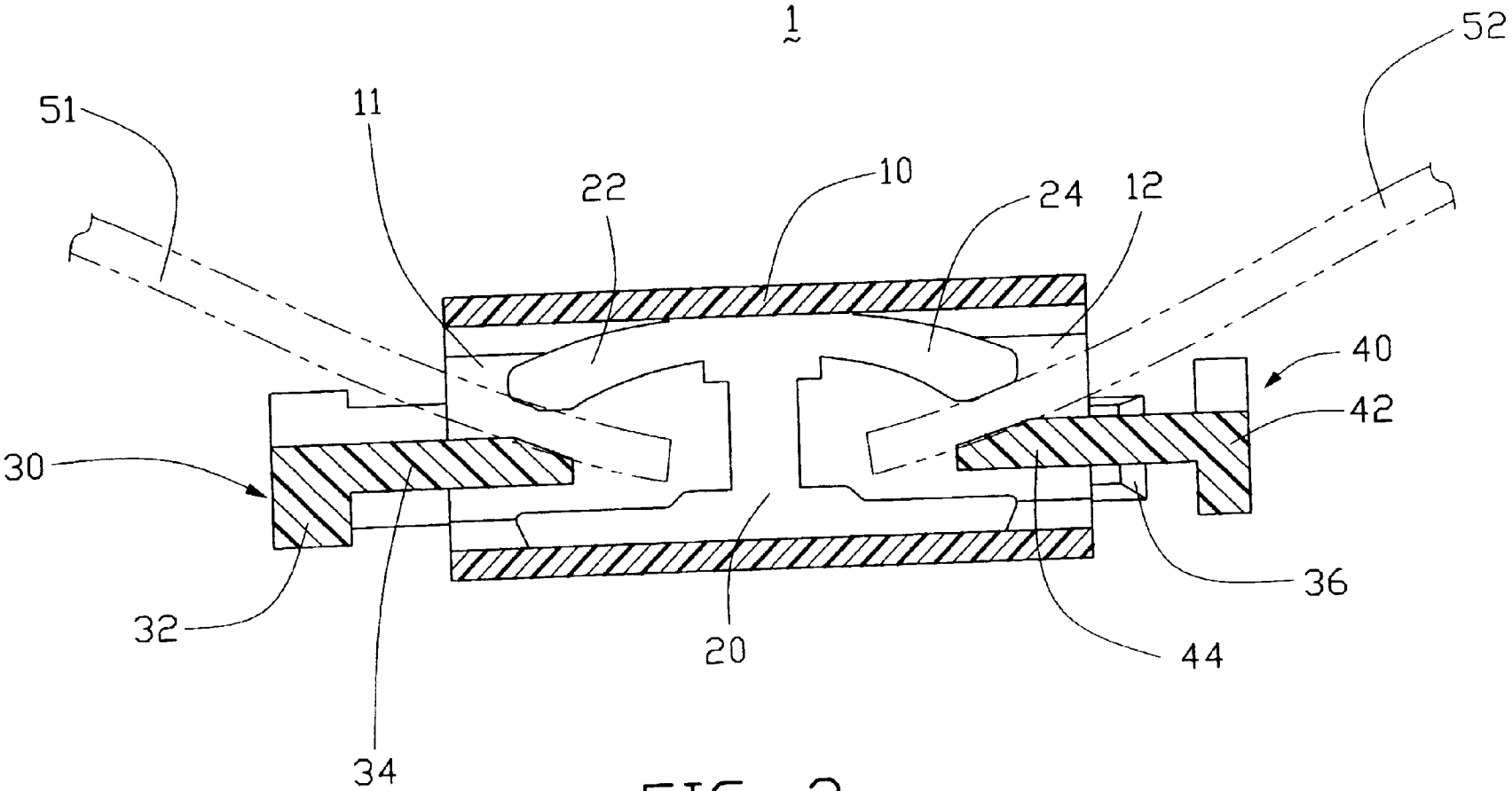
FIG. 3 is a cross-sectional view of an assembly of FIG. 2.

Referring to FIGS. 2 and 3, an FPC connector 1 in accordance with a preferred embodiment of the present invention includes a dielectric housing 10, a stuffer bar 30 and four stuffer blocks 40. The housing 10 defines a chamber 11 for receiving the stuffer bar 30 therein, and four cavities 12 at opposite sides thereof for receiving the stuffer blocks 40 therein. A plurality of terminals 20 is received in the housing 10. Each terminal 20 has a first resilient arm 22 received in the chamber 11 and an opposite second resilient arm 24 received in the cavity 12.

The stuffer bar 30 includes a crossbar 32, a support board 34 extending from a central portion of the crossbar 32, and a pair of latches 36 extending from opposite ends of the crossbar 32 along a same direction as the support board 34. The crossbar 32 defines a cutout 38 with a bottom surface (not labeled) of the cutout 38 coplanar with a top surface of the support board 34 for extension of a first FPC 51. A slope 39 is formed at a free end of the support board 34 for guiding the first FPC 51 to engage with the first resilient arms 22 of the terminals 20.

Each stuffer block 40 includes an actuating block 42 and a support block 44 extending from the actuating block 42. A recess 46 is defined in the actuating block 42 with a bottom surface thereof coplanar with a top surface of the support block 44 for extension of a second FPC 52. An incline 48 is formed at a free end of the support block 44 for guiding the second FPC 52 to engage with the second arms 24 of the terminals 20.

In assembling of the first and second FPCs 51, 52 to the FPC connector 1, the stuffer bar 30 carrying an end of the first FPC 51 on the support board 34 is received in the chamber 11 of the housing 10 with the first FPC 51 electrically connecting with the first arms 22 of the terminals 20. The other end of the First FPC 51 is electrically connected with a connector (not shown) mounted on a PCB (not shown). The crossbar 32 abuts against a first side surface of the housing 10. The latches 36 receive the housing 10 therebetween and engage with an opposite second side surface of the housing 10. The stuffer block 40 carrying an end of the second FPC 52 on the support block 44 is received in the cavity 12 of the housing 10 with the second FPC 52 electrically connecting with the second arms 24 of the terminals 20. The actuating block 42 abuts against the second side surface of the housing 10. Since the FPC connector 1 is connectable with four second FPCs 52, additional connectors to connect the other three FPCs 52 with the PCB and to be mounted on the PCB are not required, which minimizes the occupied space in the PCB.

Figure 4:
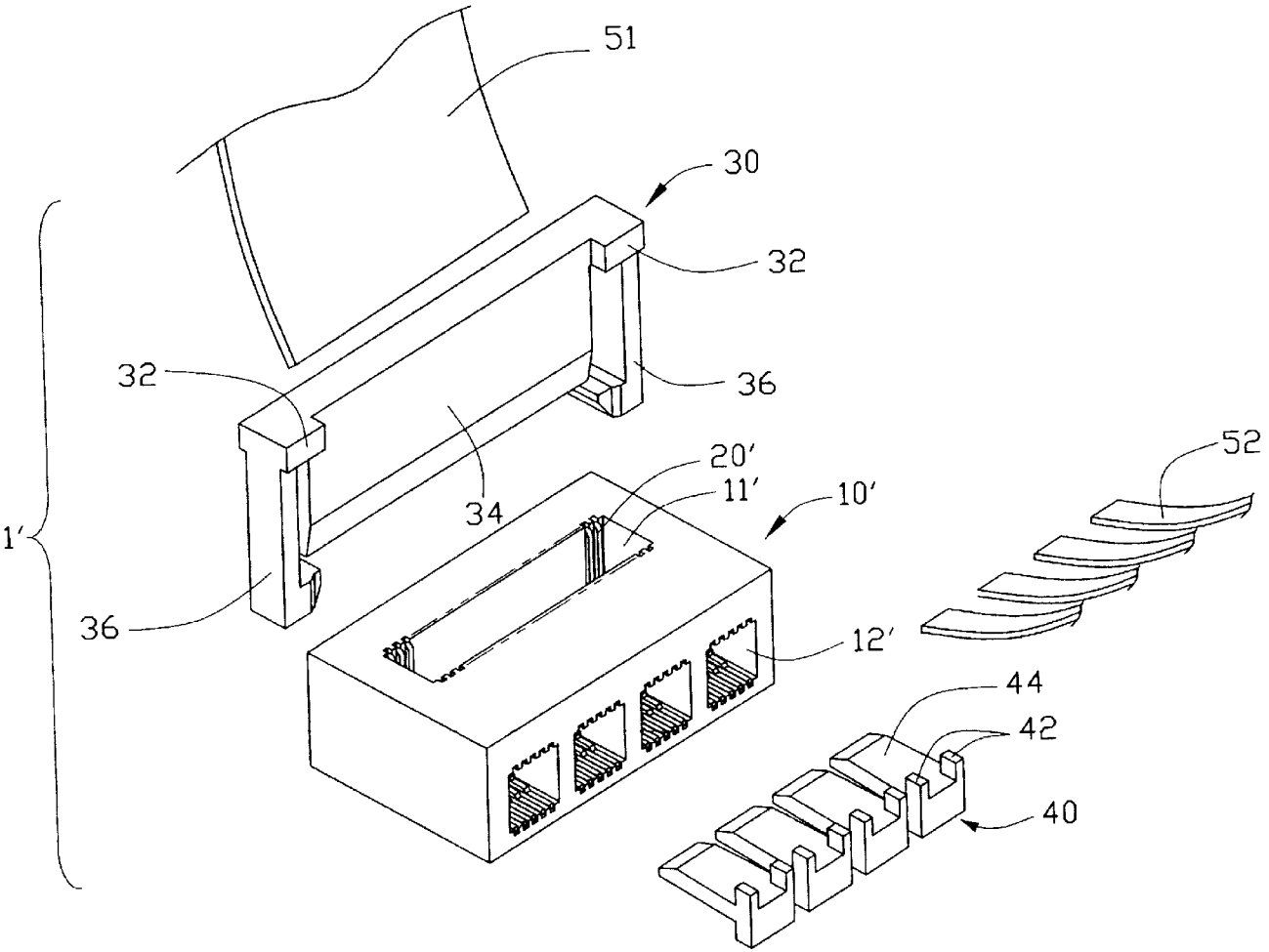
FIG. 4 is an exploded view of an FPC connector of an alternative embodimenet in accordance with the present invention.
Figure 5:
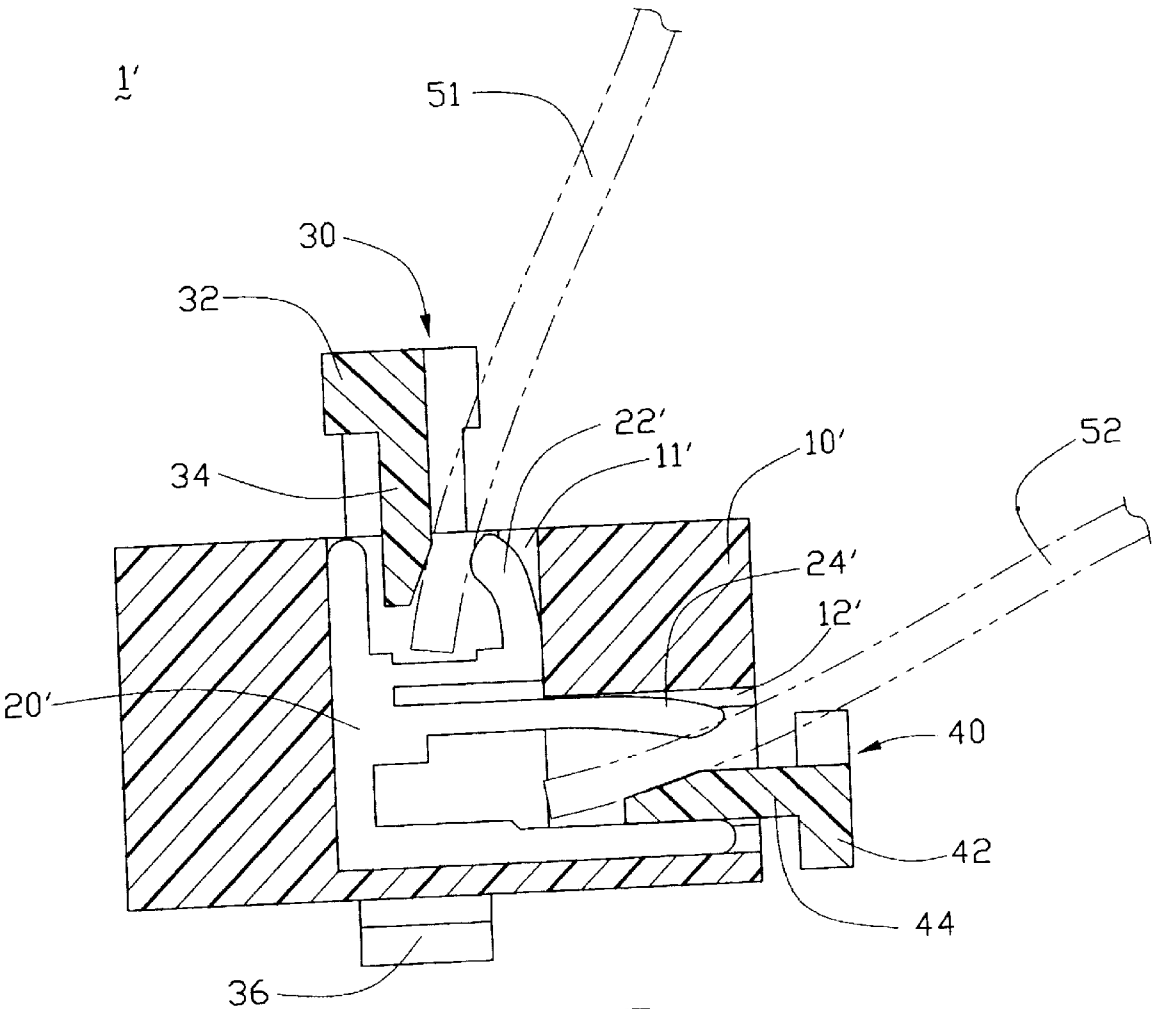
FIG. 5 is a cross-sectional view of an assembly of FIG. 4.

FIGS. 4 and 5 show an FPC connector 1' in accordance with an alternative embodiment of the present invention. The FPC connector 1' includes a dielectric housing 10', a stuffer bar 30 and four stuffer blocks 40. The housing 10' defines a chamber 11' extending from a top surface thereof and four cavities 12' extending from a side surface thereof. A plurality of terminals 20' is received in the housing. Each terminal 20' has a first resilient arm 22' received in the chamber 11' and a second resilient arm 24' received in the cavity 12'.

In assembling of the first and second FPCs 51, 52 to the FPC connector 1', the stuffer bar 30 carrying an end of the first FPC 51 on the support board 34 is received in the chamber 11' of the housing 10' with the first FPC 51 electrically connecting with the first arms 22' of the terminals 20'. The other end of the First FPC 51 is electrically connected with a connector (not shown) mounted on a PCB (not shown). The crossbar 32 abuts against the top surface of the housing 10'. The latches 36 receive the housing 10' therebetween and engage with a bottom side surface of the housing 10'. The stuffer block 40 carrying an end of the second FPC 52 on the support block 44 is received in the cavity 12' of the housing 10' with the second FPC 52 electrically connecting with the second arms 24' of the terminals 20'. The actuating block 42 abuts against the side surface of the housing 10'. Since the FPC connector 1' is connectable with four second FPCs 52, additional connectors to connect the other three FPCs 52 with the PCB and to be mounted on the PCB are not required, which minimizes the occupied space in the PCB.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A connector comprising:

a housing defining a chamber and a plurality of cavities;

a stuffer bar received in the chamber of the housing for carrying a first flexible printed circuit (FPC); and a plurality of stuffer blocks received in the cavities for carrying a plurality of second FPCs thereby electrically connecting the second FPCs with the first FPC;

wherein the chamber extends through a first surface of the housing and the cavities extend through a second side surface of the housing, and the first side surface is perpendicular to the second side surface.

2. The connector as claimed in claim 1, wherein a plurality of terminal is received in the housing and electrically contact with the first and second FPCs.

3. The connector as claimed in claim 2, wherein each terminal comprises a first resilient arm received in the chamber of the housing for contacting with the first FPC, and a second resilient arm received in the cavity for contacting with the second FPC.

4. The connector as claimed in claim 1, wherein the stuffer bar comprises a crossbar abutting against the housing, and a support board extending from the crossbar and received in the chamber for carrying the first FPC.

5. The connector as claimed in claim 4, wherein a pair of latches extends from opposite ends of the crossbar, receives the housing therebetween and engages with a surface of the housing.

6. The connector as claimed in claim 1, wherein each stuffer block comprises an actuating block and a support block extending from the actuating block and received in the cavity for carrying the second FPC.

7. An electrical connector comprising:

a housing defining a chamber for receiving a first FPC connected with an electronic device and a plurality of cavities for receiving a plurality of second FPCs respectively connected with other electronic devices; and a plurality of terminals received in the housing, each terminal comprising a first resilient arm received in the chamber and a second resilient arm received in the cavities;

wherein the chamber extends through a first surface of the housing and the cavities extend through a second side surface of the housing, and the first side surface is perpendicular to the second side surface.

8. An electrical connector assembly comprising:

an insulative housing defining a wider cavity and a plurality of narrower cavities, said first cavity and at least one of said second cavities facing two different directions;

a plurality of terminals disposed in the housing each with a first contact portion extending into the first cavity and a second contact portion extending into the corresponding second cavity;

a wider FPC inserted into the first cavity and mechanically and electrically engaged with the first contact portions; and a plurality of narrower FPC respectively inserted into the corresponding second cavities and mechanically and electrically engaged with the second contact portions.

9. The assembly as claimed in claim 8, wherein said housing is made as one piece.

* * * * *